United States Patent [19]

Guglielmi

[11] 4,029,377

[45] June 14, 1977

[54] PUSH-ON BUS BAR

[75] Inventor: Anthony C. Guglielmi, Plainfield, Conn.

[73] Assignee: Rogers Corporation, Rogers, Conn.

[22] Filed: Feb. 3, 1976

[21] Appl. No.: 654,846

[52] U.S. Cl. ..... 339/19

[51] Int. Cl.[2] ..... H01R 31/08

[58] Field of Search ..... 339/19, 222, 22 B

[56] References Cited

UNITED STATES PATENTS

| | | | |
|---|---|---|---|
| 3,149,893 | 9/1964 | Dupre | 339/19 |
| 3,725,843 | 4/1973 | Johnson | 339/19 |
| 3,932,013 | 1/1976 | Yeager et al. | 339/19 |

*Primary Examiner*—Francis S. Husar

*Assistant Examiner*—John McQuade

[57] ABSTRACT

A bus connector for use in the interconnection of terminal posts arranged in a linear array includes a non-conductive housing which defines passages through which the terminal posts may pass. The connector also includes at least one conductor extending along a side surface of the housing; the conductor preferably having a dual comb-like construction with fingers extending from the opposite edges thereof. These fingers pass around the edges of the housing and the fingers extending from a first edge of the conductor project into the passages to function as spring contacts for the terminal pins. The conductor fingers cooperate with walls of the housing to mechanically hold the conductor on the housing.

24 Claims, 3 Drawing Figures

PUSH-ON BUS BAR

BACKGROUND OF THE INVENTION

1. Field of the Invention

The present invention relates to the interconnection of electronic circuits and components. More specifically, this invention is directed to electrical conductors and particularly bus bars for interconnecting preselected terminal posts on terminal blocks, back planes, card edge connectors and circuit boards. Accordingly, the general objects of the present invention are to provide novel and improved articles of such character.

2. Description of the Prior Art

In many types of electronic equipment, for example computers and electronic telephone switching systems, it is standard practice to mount components such as integrated circuits, transistors, and passive circuit elements on circuit boards which are received in card edge connectors. These connectors are provided, on one side, with terminal posts to which circuits on the board are electrically connected via "printed" connectors on the circuit boards and contacts on the connectors. The terminal posts, which are oriented transversely to the plane of the connector and often referred to as "wire wrap" pins, are used to establish interconnection between and for applying power to various circuits in the equipment.

It is known in the art to interconnect terminal posts on card edge connectors; and also on terminal blocks, back planes and circuit boards; through the use of push-on bus bars. Such push-on bus bars include a conductive member which is spring loaded against the terminal posts. Examples of prior art push-on bus bars may be found in U.S. Pat. Nos. 3,448,620; 3,582,864 and 3,829,818. With the exception of the bus bar of U.S. Pat. No. 3,829,818, which is assigned to the assignee of the present invention, the prior art push-on type bus bars have been characterized by one or more electrical or mechanical deficiencies. These deficiencies include unreliable contact between the pin or post and bus bar connector, high push-on forces which necessitated the use of special installation tools and/or awkward and time consuming hand insertion, and a sliding contact between the terminal pin or post and a sharp edge on the bus bar conductor which resulted in the scraping of the pins during bus bar insertion. The scraping of the pins often caused flaking of conductive material from the pins with the resultant contamination of adjacent circuits. Further disadvantages of prior art push-on type bus bars included distortion of the contacts or the contact surfaces on the bus bar, and in some cases also distortion of the pins; such distortion preventing removal and reinsertion and thus precluding reuse of the bus bars. Additionally, isolation or insulation of terminal pins which were not to be "commoned" by the bus bar was often awkward and time consuming and only one circuit program could be accomplished with a given bus bar. With regard to the programmability of the bus bar, it is highly desirable to afford the ultimate user of the device the option of selecting those terminal posts in a linear array which are not to be interconnected by a bus bar which extends along such array. As a further deficiency of many prior art push-on bus bars, these devices have been characterized by very limited current carrying capability and thus limited utility.

SUMMARY OF THE INVENTION

The present invention overcomes all of the above briefly discussed and other deficiencies and disadvantages of the prior art and thus provides a novel and improved push-on bus bar which may be used in the interconnection of terminal posts. A bus bar in accordance with the present invention is characterized by reliability, high current carrying capacity and ease of insertion. The ease of insertion of the bus bars of the invention produces the desirable results that the bus contacts are not distorted, there is no danger of contamination of adjacent circuits by slivers or flakes of conductive material and that the bus bar may be installed and removed by hand and is thus reusable. Also, push-on bus bars in accordance with the present invention may be easily "programmed" and have built-in and positive isolation of terminal posts which are not "commoned".

The push-on bus bars of the invention include a nonconductive housing, hereinafter referred to as the barrier strip, which may be molded and/or machined from any suitable plastic material. The barrier strip is formed with a plurality of passages through which terminal posts may pass and, in a preferred embodiment, the upper and lower edges of the barrier strip are provided with notches which are in registration with the terminal post receiving passages.

The conductive portions of bus bars in accordance with the invention are formed by any suitable conventional technique and are provided with "teeth" which extend outwardly from the oppositely disposed edges thereof. These teeth are spaced so as to be in registration with the notches in the barrier strip. Along a first edge of the barrier strip, the teeth on a first edge of a conductor are bent over so as to establish a mechanical connection between the conductor and barrier strip; the central portion of the conductor thus being in contact with and coplanar with a side of the barrier strip. The teeth at the second or opposite edge of the conductor are considerably longer than those at the first edge and, where present, are bent through the notches in the second edge of the barrier strip and are extended downwardly into the terminal post receiving channels in the barrier strip. These elongated bent over teeth, which may be comprised of a material having greater resiliency than the remainder of the conductor, extend angularly across the channels in the barrier strip to define spring contacts which engage and establish an electrical circuit with the terminal posts. In passing about the edges of the notches in the barrier strip the teeth at the second edge of a conductor mechanically connect this side of the conductor to the barrier strip.

In order to program the push-on bus bars of the present invention the elongated spring contact defining conductor teeth may be omitted as desired. Also, bus conductors may be provided on both sides of the barrier strip and either oppositely facing spring contacts employed to maximize reliability and current carrying capability or the conductors on both sides of the barrier strip may be programmed to enhance design flexibility. It is also possible to stack the push-on bus bars of the present invention vertically in the interest of further programming flexibility and enhancing current carrying capacity.

The combination of the plastic barrier strip or housing with the spring-conductors results in a novel arrangement wherein terminal pins may be led into the contacts. Accordingly, when using the present invention slightly mis-aligned pins will be properly guided to the contacts.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENTS

Figure 1:
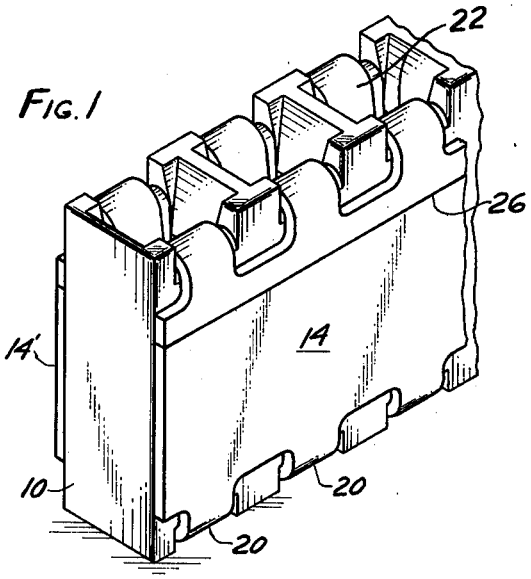
FIG. 1 is a perspective view of a portion of a two conductor bus bar in accordance with a first embodiment of the invention.
Figure 2:
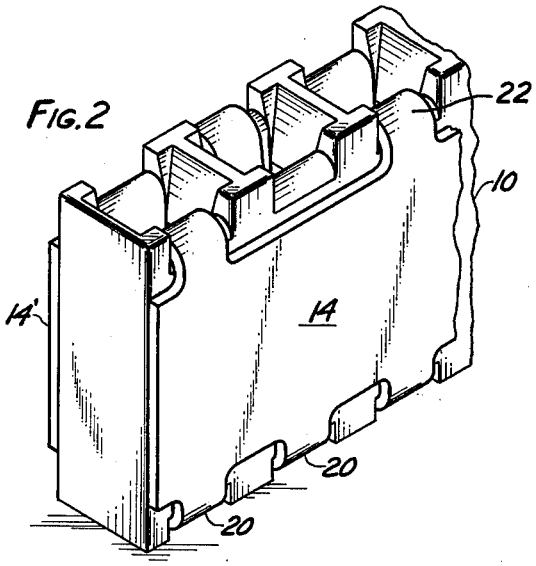
FIG. 2 is a perspective view of a portion of the bus bar of FIG. 1 as modified for coupling two sources of electrical potential to an associated circuit.
Figure 3:
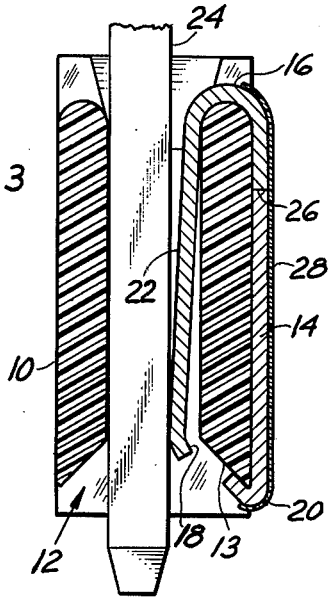
FIG. 3 is a cross-sectional side elevation view of a single conductor bus bar in accordance with the present invention.

With reference now jointly to FIGS. 1–3, a bus bar in accordance with the present invention comprises a support member or barrier strip 10. Barrier strip 10 will typically be injection molded and will formed of a thermosetting or thermoplastic material having the appropriate electrical and mechanical properties. Considering the orientation of the bus bar as shown in the drawing, barrier strip 10 is provided with a plurality of linearly aligned channels which extend vertically therethrough. One of these channels has been generally indicated in FIG. 3 at 12.

The barrier strip 10 has oppositely disposed planar sides. At least one and usually both sides of strip 10 are notched as shown along the upper and lower edges. The notches along the oppositely disposed edges of the sides of the barrier strip are in alignment with the vertical channels. Referring again to FIG. 3, it may be seen that the base portions of the notches in the upper edge of the barrier strip are preferably rounded. Also, the notches are usually substantially deeper than the thickness of any conductor which may be passed therethrough thereby providing protection from accidental contact with adjacent conductors. The depth of the notches along the lower edge of each side of the barrier strip is commensurate with the depth of the upper edge notches. However, rather than being formed with rounded base portions, the notches in the lower edges of the barrier strip have generally linear base portions 13 which are directed angularly upwardly and inwardly with respect to the channels 12; the base portions 13 defining sharp bend lines.

Push-on bus bars in accordance with the present invention may be provided with either a single bus conductor, as depicted in FIG. 3, or a pair of oppositely disposed conductors as shown in FIGS. 1 and 2. The conductors are mechanically attached to the sides of barrier strip 10 in such a manner that a planar central current carrying portion of the conductor or conductors is coplanar with and in contact with the side or sides of the barrier strip. The conductors are provided, extending from the oppositely disposed upper and lower edges thereof, with teeth; i.e., the oppositely disposed edges of the bus conductors are generally comb-shaped. As may be seen from a joint consideration of FIGS. 1 and 3, the teeth 20 at the lower edge of the bus conductor which has been indicated generally at 14 are of short length when compared to the teeth 22 extending from the upper edge of the conductor. One of teeth 20 will typically be provided to engage each of the notches in the lower edge of the side of barrier strip 10. During the course of assembly of the push-on bus bars of the present invention the teeth 20 of conductor 14 are passed through the notches in the lower edge of the barrier strip and are bent back on themselves sharply inwardly and upwardly as clearly shown in FIG. 3; this sharp bending exceeding the elastic limit of the metal and thus mechanically locking the conductor 14 along its lower edge to the side of barrier strip 10.

As previously noted, the teeth 22 which extend from the upper edge of bus conductor 14 are of substantial length. As may also be seen from FIG. 3, these teeth are formed so as to pass around the rounded base portion of the notches in the upper edge of barrier strip 10, as indicated at 16, and downwardly into the vertical channels 12 in the barrier strip. In passing down into channels 12 in the barrier strip the teeth extend toward the opposite channel defining side wall. The smooth bending of teeth 22 about the rounded base portion of the notches in the upper edge of the barrier strip will not exceed the elastic limit of the metal and thus the portions of the bus conductor teeth 22 which extend into the channels in the barrier strip will function as contact springs. As may be seen from FIG. 3, when the push-on bus bar is installed on a card edge connector firm electrical contact will be established between contact spring or tooth 22 and a terminal pin, such as pin 24, which contacts and thus compresses the spring. The free end of the contact springs 22 are bent slightly inwardly on themselves, as indicated at 18, to prevent hang up of the contacts on the terminal pins during installation of the bus bar. It is also to be noted that the combination of the plastic housing with the contact springs results in a lead in effect whereby slightly misaligned pins will be guided into the contacts.

The bus conductors, such as conductor 14, may be formed entirely from a sheet of conductive material such as beryllium copper alloy. When a beryllium-copper alloy is utilized the copper is employed for its current carrying capabilities while the beryllium is employed because of its mechanical properties and particularly its strength and resiliency. Thus, if conductivity requirements are sufficiently low, in the interest of reducing cost of the bus bar, the conductors 14 including the lower and upper teeth 20 and 22 will be stamped or etched from a sheet of beryllium copper. FIG. 2 depicts an embodiment where the bus conductors 14 are fabricated from a copper alloy sheet. For numerous applications, however, it is desired that the major current carrying portion of the bus conductors be comprised of pure copper. Copper, of course, is generally too soft to function properly as a spring-contact. Accordingly, as depicted in the embodiments of FIGS. 1 and 3, the bus conductors may be bimetallic with an upper portion; i.e., a portion situated above a weld line 26, being formed from a beryllium copper alloy while the remaining portion of the bus conductors are formed of copper. Thus, still considering FIGS. 1 and 3, the portion of the bus conductors above weld line 26, such portion including the spring contacts 22, will be formed from a conductive alloy having the requisite strength and resiliency while the major planar portion of the conductor; i.e., the portion below weld line 26 and including the teeth 20 which function only to mechanically retain the bus conductors on the barrier strip; will be comprised of copper. The two portions of the bus conductor are joined by a butt weld which may, for example, be accomplished employing electron beam welding.

For most applications it is necessary or desirable to cover the exposed surfaces of conductor 14 with some type of insulating material in order to eliminate the possibility of accidental short circuiting. This insulating may be accomplished by applying a layer 28 of a polymeric material, either in tape or liquid form, to all exposed surfaces of copper layer 16 except the portion of spring contact 22 which extends into the channel in barrier strip 10. This layer of insulation 28 has been shown only in FIG. 3 and it will be understood that similar layers of insulation may be applied to the bus conductors 14 of FIGS. 1 and 2 if deemed necessary or desirable.

In the embodiment of the invention shown in FIG. 1 spring contacts extend into all of the channels in barrier strip 10 from the opposite sides of each channel. Accordingly, terminal pins received in such channels will be contacted on two sides by spring contacts and the current carrying capacity of the bus bar will be enhanced. In the FIG. 1 embodiment the bus conductors 14 and 14′ on the opposite sides of the barrier strip will be connected to a common source of potential and all of the terminal pins received in the channels in the bus bar will be commoned.

In the FIG. 2 embodiment the bus bar has been programmed whereby alternate channels are provided with spring contacts respectively extending from conductors 14 and 14′. Thus, in the FIG. 2 embodiment a bus conductor may be employed to couple two separate sources of potential to the electric circuit which is connected to the terminal pins received in the bus bar. It will, of course, be understood that the alternate arrangement of FIG. 2 is depicted as an example only and any desired pattern of terminal pin-bus conductor contact may be established in the course of fabrication of the bus conductors 14 and 14′.

The embodiment of FIG. 3 differs from that of FIGS. 1 and 2 in that a bus conductor 14 is provided on one side only of barrier strip 10. The bus conductor 14 of the FIG. 3 embodiment may, of course, be programmed so as to common desired terminal pins. In channels which are not provided with a spring contact 22, in all embodiments of the invention, the terminal pins will be fully insulated from the bus conductors; i.e., the bus bars of the present invention offer the possibility of built-in and positive isolation of terminal pins which are not commoned.

While not necessary for proper operation of the invention, the attachment of the bus conductors to the barrier strip may be enhanced through the use of a suitable adhesive applied to the planar side faces of barrier strip 10.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An electrical bus connector for interconnecting terminal pins of a linear array comprising:

an elongated housing, said housing being formed from a nonconductive material and being provided with a plurality of passages extending therethrough from oppositely disposed first and second sides thereof, said passages being arranged in a linear array for receiving terminal pins to be interconnected;

at least a first bus conductor, said first conductor having a first portion which is adjacent to a third side of said housing, said third housing side extending between said first and second sides, said first conductor being provided with a first plurality of fingers extending outwardly from a first edge thereof, said first conductor first edge facing the junction of said first and third housing sides and said fingers of said first plurality of fingers being spaced in a pattern defined by the terminal pins to be interconnected and having a width less than the width of said housing passages, said fingers of said first plurality of fingers passing about the junction of said housing first and third sides into preselected of said passages whereby said fingers define spring contacts for establishing electrical connections with the terminal pins extending through housing passages into which said fingers extend; and mounting means mounting said first conductor on said housing.

2. The bus connector of claim 1 wherein said means mounting said first conductor on said housing comprises:

a second plurality of fingers extending outwardly from a second edge of said first conductor, said first conductor second edge facing the junction of said housing second and third sides, the fingers of said second plurality of fingers passing about the junction of said housing second and third sides and cooperating with said fingers of said first plurality of fingers to mechanically affix said first conductor to said housing.

3. The bus connector of claim 1 wherein said housing passages each receive a single terminal pin and said housing further includes a first plurality of notches at the junction of said first and third sides thereof, said notches of said first plurality of notches being in alignment with said passages whereby said conductor fingers of said first plurality of fingers will be positioned in at least some of said notches of said first plurality of notches.

4. The bus connector of claim 3 wherein the base portions of said notches of said first plurality of notches define a smooth bend about which said conductor fingers of said first plurality of fingers pass before extending downwardly with respect to their root portions and outwardly with respect to the passages.

5. The bus connector of claim 4 wherein said means mounting said first conductor on said housing comprises:

a second plurality of fingers extending outwardly from a second edge of said first conductor, said first conductor second edge facing the junction of said housing second and third sides, the fingers of said second plurality of fingers passing about the junction of said housing second and third sides and cooperating with said fingers of said first plurality of fingers to mechanically affix said first conductor to said housing.

6. The bus connector of claim 5 wherein said housing further includes a second plurality of notches at the junction of said second and third sides, said notches of said second plurality of notches being in registration with said housing passages and defining a sharp bend line to which the conductor fingers of said plurality of fingers are conformed.

7. The bus connector of claim 1 further comprising:

a second bus conductor, said second conductor having a first portion which is adjacent to a fourth side of said housing, said fourth housing side extending between said first and second sides, said second conductor being provided with a first plurality of fingers extending outwardly from a first edge thereof, said second conductor first edge facing the junction of said first and fourth housing sides and said fingers of said first plurality of finger of said second conductor being spaced in a pattern defined by terminal pins to be interconnected, said second conductor fingers of said first plurality of fingers having a width less than the width of said housing passages, said fingers of said first plurality of fingers of said second conductor passing about the junction of said housing first and fourth sides and into preselected of said passages to define spring contacts located in said preselected passages; and mounting means mounting said second conductor to said housing.

8. The bus connector of claim 7 wherein said mounting means mounting said first and second conductors on said housing each comprises:

a second plurality of fingers extending outwardly from a second edge of each of said conductors, the second edges of said conductors being oppositely disposed from said conductor first edges and facing the junction of said adjacent housing sides and said housing second side, the fingers of said second plurality of fingers passing about the junction of said housing adjacent and second sides and cooperating with the fingers of said first plurality of fingers of each of said conductors to mechanically affix said conductors to said housing.

9. The bus connector of claim 7 wherein said housing passages each receive a single terminal pin and said housing further includes a first plurality of notches at the junction of said first and third sides thereof and at the junction of said first and fourth sides thereof, said notches being in alignment with said passages whereby said conductor fingers of said first plurality of fingers of each of said first and second bus conductors will be positioned in notches of said first plurality of notches.

10. The bus connector of claim 9 wherein the base portions of said notches define a smooth bend about which said conductor fingers pass before extending downwardly with respect to their root portions and outwardly with respect to the passages.

11. The bus connector of claim 10 wherein said mounting means mounting said first and second conductors on said housing each comprises:

a second plurality of fingers extending outwardly from a second edge of each of said conductors, the second edges of said conductors being oppositely disposed from said conductor first edges and facing the junction of said adjacent housing sides and said housing second side, the fingers of said second plurality of fingers passing about the junction of said housing adjacent and second sides and cooperating with the fingers of said first plurality of fingers of each of said conductors to mechanically affix said conductors to said housing.

12. The bus connector of claim 11 wherein said housing further includes second pluralities of notches at the junction of said second and third sides thereof and at the junction of said second and fourth sides thereof, said notches of said second pluralities of notches being in registration with said housing passages and defining a sharp bend line to which the conductor fingers of said second plurality of fingers of each of said first and second bus conductors are conformed.

13. The bus connector of claim 1 wherein said first plurality of fingers of said first conductor and part of said first portion of said first conductor interconnecting the roots of said fingers of said first plurality of fingers is comprised of a first metal and the remainder of said first conductor is comprised of a second metal.

14. The bus connector of claim 6 wherein said first plurality of fingers of said first conductor and part of said first portion of said first conductor interconnecting the roots of said fingers of said first plurality of fingers is comprised of a first metal and the remainder of said first conductor is comprised of a second metal.

15. The bus connector of claim 7 wherein said first plurality of fingers of said first and second conductors and part of said first portion of said first and second conductors interconnecting the roots of said fingers of said first pluralities of fingers is comprised of a first metal and the remainder of said bus conductors is comprised of a second metal.

16. The bus connector of claim 12 wherein said first plurality of fingers of said first and second conductors and part of said first portion of said first and second conductors interconnecting the roots of said fingers of said first pluralities of fingers is comprised of a first metal and the remainder of said bus conductors is comprised of a second metal.

17. The bus connector of claim 7 wherein said fingers of said first plurality of fingers of said first and second conductors extend only into different passages in said housing whereby said bus connector may deliver two different potentials to a terminal pin array.

18. The bus connector of claim 12 wherein said fingers of said first plurality of fingers of said first and second conductors extend only into different passages in said housing whereby said bus connector may deliver two different potentials to a terminal pin array.

19. The bus connector of claim 1 wherein said first conductor first portion has a first side abutting said housing third side and wherein said first conductor further comprises:

a layer of insulating material disposed over at least a portion of the second side of said first portion of said first conductor, said second side of said first conductor being parallel to said first conductor first side.

20. The bus connector of claim 6 wherein said first conductor first portion has a first side abutting said housing third side and wherein said first conductor further comprises:

a layer of insulating material disposed over at least a portion of the second side of said first portion of said first conductor, said second side of said first conductor being parallel to said first conductor first side.

21. The bus connector of claim 7 wherein said first and second conductor first portions each have a first side abutting said housing third and fourth sides, respectively, and wherein said conductors further comprise:

a layer of insulating material disposed over at least a portion of the second sides of said first portions of said first and second conductors, said second sides of said first and second conductors being parallel to said conductor first sides.

22. The bus connector of claim 12 wherein said first and second conductor first portions each have a first side abutting said housing third and fourth sides, respectively, and wherein said conductors further comprise:

a layer of insulating material disposed over at least a portion of the second sides of said first portions of said first and second conductors, said second sides of said first and second conductors being parallel to said conductor first sides.

23. The bus connector of claim 16 wherein said first and second conductor first portions each have a first side abutting said housing third and fourth sides, respectively, and wherein said bus conductors further comprise:

a layer of insulating material disposed over at least a portion of the second sides of said first portions of said first and second conductors, said second sides of said first and second conductors being parallel to said conductor first sides.

24. The bus connector of claim 23 wherein said fingers of said first plurality of fingers of said first and second conductors extend only into different passages in said housing whereby said bus connector may deliver two different potentials to a terminal pin array.

* * * * *